US005160169A

United States Patent [19]

Juan

[11] Patent Number: 5,160,169

[45] Date of Patent: Nov. 3, 1992

[54] HAIR STYLE ALBUM

[76] Inventor: Hsuan-Chun Juan, P.O. Box 82-144, Taipei City, Taiwan

[21] Appl. No.: 871,836

[22] Filed: Apr. 20, 1992

[51] Int. Cl.[5] ..... B42D 1/00

[52] U.S. Cl. ..... 281/15.1; 40/158.1; 402/70

[58] Field of Search ..... 281/2, 15.1, 22, 29, 281/31, 51, 21.1; 402/70; 283/117; 40/158.1, 159.2, 159, 156

[56] References Cited

U.S. PATENT DOCUMENTS

| | | | |
|---|---|---|---|
| 3,797,146 | 3/1974 | Holes | 40/159 X |
| 3,958,348 | 5/1976 | Sakamoto | 40/158 X |
| 4,916,838 | 4/1990 | Holson | 40/159 |
| 4,934,739 | 6/1990 | Stancato | 281/38 |
| 5,025,581 | 6/1991 | Polzin | 40/159 |

*Primary Examiner*—Timothy V. Eley
*Assistant Examiner*—Willmon Fridie, Jr.
*Attorney, Agent, or Firm*—Alfred Lei

[57] ABSTRACT

This invention relates to a hair style album and in particular to one including a front cover provided with a plurality of lattices, an intermediate layer mounted under the front cover and having a plurality of recesses on the upper side, a photograph holder designed to be inserted into any one of the recesses of the intermediate layer, and a bottom cover arranged under the intermediate layer, whereby various kinds of hair styles associated with a client's head and face may be offered to the client before arranging hair.

1 Claim, 3 Drawing Sheets

HAIR STYLE ALBUM

BACKGROUND OF THE INVENTION

Generally speaking, it is difficult for one to find out one's suitable hair styles and so there is a need for an album which may show the client a variety of hair styles. However, the album only shows various kinds of hair styles of a model, and cannot provide direct match of the hair style with the client.

Therefore, it is an object of the present invention to provide a hair style album which may obviate and mitigate the above-mentioned drawbacks.

SUMMARY OF THE INVENTION

This invention relates to a hair-style album.

It is the primary object of the present invention to provide a hair-style album which is designed to offer various kinds of hair styles to one who wants to arrange one's hair.

It is another object of the present invention to provide a hair-style album which may furnish references to the client.

It is still another object of the present invention to provide a hair-style album which is simple in construction.

It is still another object of the present invention to provide a hair-style album which is economic to produce.

It is a further object of the present invention to provide a hair-style album which is helpful for selecting the most suitable hair style for a customer.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
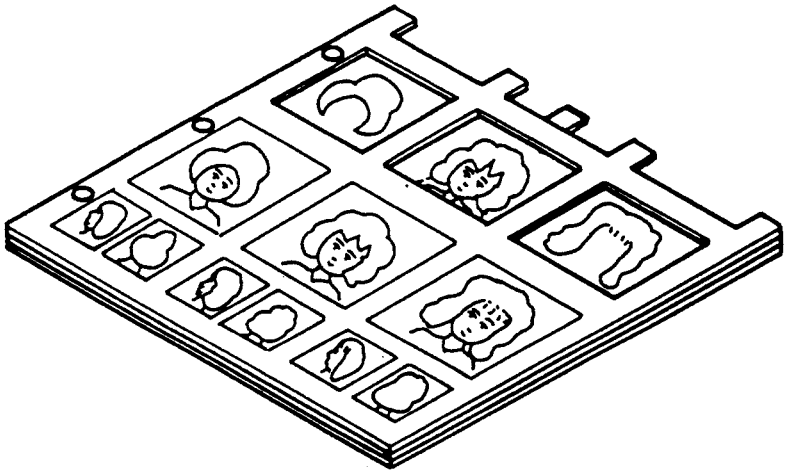
FIG. 1 is a perspective view of a hair-style album.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
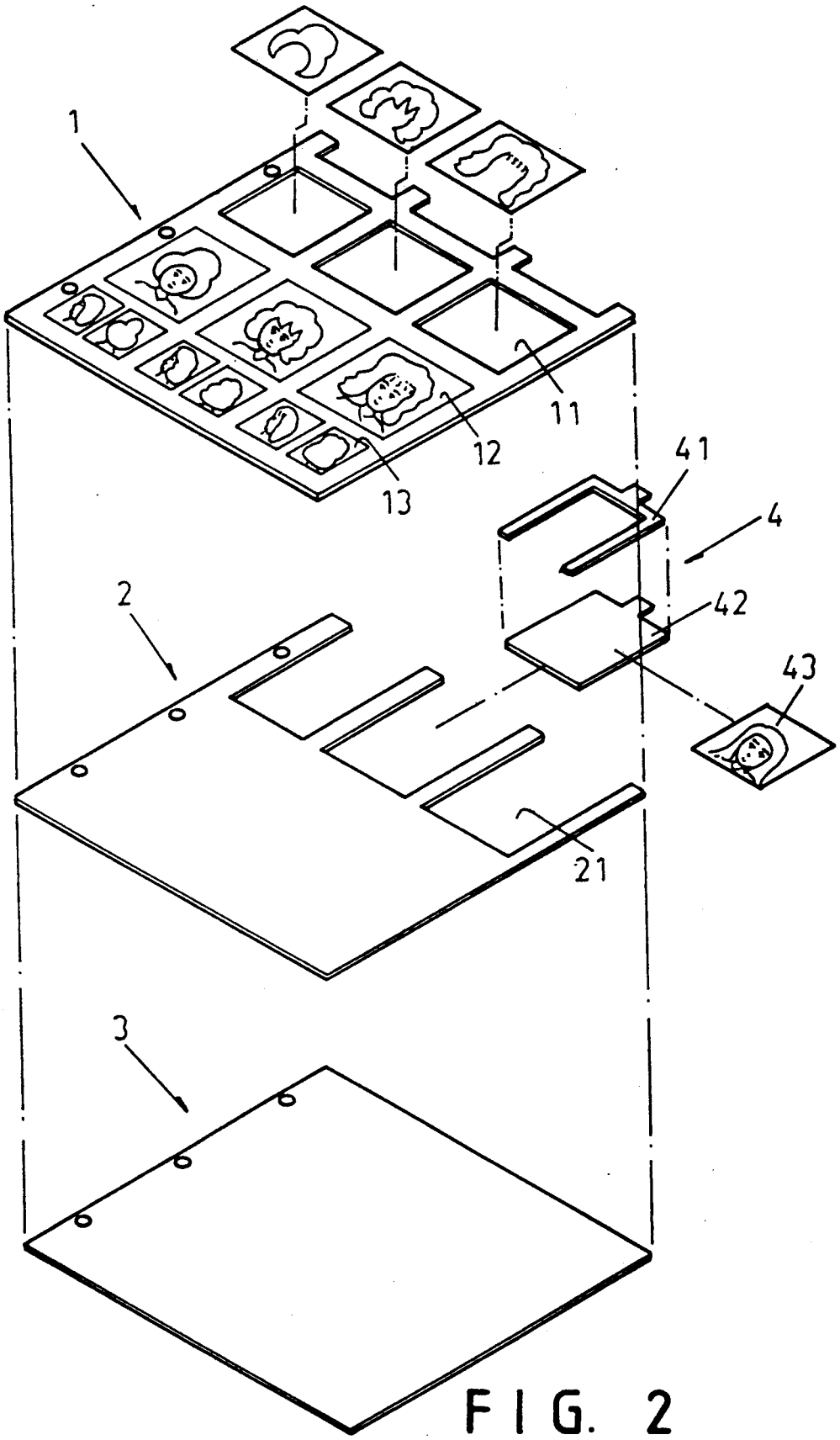
FIG. 2 is an exploded view of the hair-style album.
Figure 3:
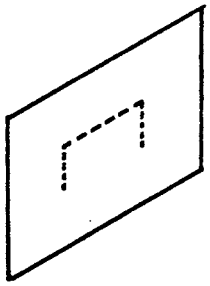
FIG. 3 shows the window of the camera.
Figure 4:
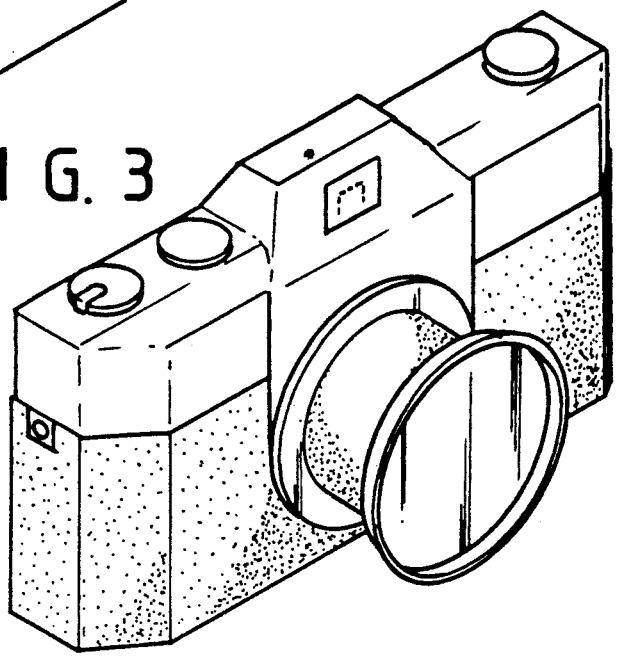
FIG. 4 shows a camera with the window.
Figure 5:
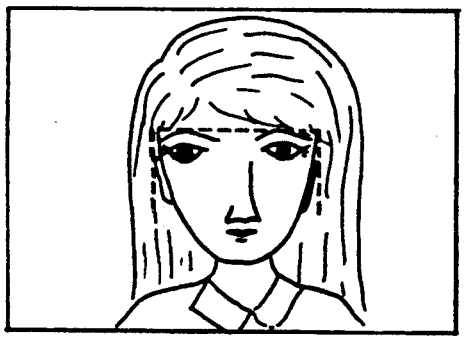
FIG. 5 is a photograph taken with the camera.

With reference to the drawing and in particular to FIGS. 1 and 2 thereof, the hair-style album according to the present invention mainly comprises a front cover 1, an intermediate layer 2, and a bottom cover 3. The front cover 1 is provided with a first row of lattices 11, a second row of lattices 12, and a third row of lattices 13. The lattices 11 at the first row are provided with a transparent plastic film on which is printed a hair style. On each lattice 12 of the second row there is fitted a photograph of a model. Below each lattice 12 there are two lattices on each of which are mounted a first photograph taken from the lateral side of the model and a second photograph taken from the back side of the model.

The intermediate layer 2 is mounted under the front cover 1 and has three recesses 21 on the upper side. The three recesses 21 of the intermediate layer 2 are just located under the three lattices 11 of the first row of the front cover 1.

The photograph holder 4 is designed to be inserted into any one of the recesses 21 of the intermediate layer 2. Further, the photograph holder 4 includes an upper sheet 41 and a lower sheet 42 having two arms stuck on the upper sheet 41 so that a photograph 43 may be inserted between the upper sheet 41 and a lower sheet 42.

In order to obtain an image with a size adapted to the hair style, an inverted U-shaped sign 5 is marked on the window of the camera.

When in use, simply take a photograph of the client and then insert it into the photograph holder 4. Thereafter, insert the photograph holder 4 together with the photograph of the client into any desired one of the recesses 21 of the intermediate layer 2 so as to match with the hair style on the lattice 11 of the first row thereby enabling the client to choose the most appropriate hair style.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A hair-style album comprising:

a front cover provided with three rows of lattices, each lattice of the first row being fitted with a transparent film on which is printed a hair style, each lattice of the second row being provided with a photograph of a model, and the lattices of the third row having a photograph showing lateral view and rear view of the model;

an intermediate layer mounted under said front cover and having three recesses on the upper side, the recesses of said intermediate layer being just located under the three lattices of said first row of said front cover;

a photograph holder designed to be inserted into any one of the recesses of said intermediate layer and including an upper sheet and a lower sheet having two arms stuck on said upper sheet so that a photograph may be inserted between said upper sheet and said lower sheet; and a bottom cover arranged under said intermediate layer.

* * * * *